US006200088B1

(12) United States Patent
Zombo et al.

(10) Patent No.: US 6,200,088 B1
(45) Date of Patent: Mar. 13, 2001

(54) ON-LINE MONITOR FOR DETECTING EXCESSIVE TEMPERATURES OF CRITICAL COMPONENTS OF A TURBINE

(75) Inventors: Paul J. Zombo, Cocoa; Brij B. Seth, Maitland; Kent G. Hultgren, Winter Park, all of FL (US); Michael A. Burke, Pittsburgh, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/566,572

(22) Filed: May 8, 2000

Related U.S. Application Data

(62) Division of application No. 09/129,905, filed on Aug. 6, 1998, now Pat. No. 6,062,811.

(51) Int. Cl.[7] ..... F01D 5/18

(52) U.S. Cl. ..... 415/118; 416/61; 416/97 R; 416/241 R; 415/115; 415/118

(58) Field of Search ..... 415/118, 114, 415/115; 416/96 A, 96 R, 97 A, 97 R, 61, 241 R, 241 B; 1/115

(56) References Cited

U.S. PATENT DOCUMENTS 4,658,638 * 4/1987 Plahmer ..... 73/7
4,933,556 * 6/1990 Stewart et al. ..... 250/390.01
5,239,823 * 8/1993 Sims ..... 60/271

FOREIGN PATENT DOCUMENTS

3638265 * 11/1986 (DE) .

* cited by examiner

*Primary Examiner*—Edward K. Look
*Assistant Examiner*—Liam McDowell
(74) *Attorney, Agent, or Firm*—Eckert Seamans Cherin & Mellott, LLC

(57) ABSTRACT

A monitor for detecting overheating of a critical component in a combustion turbine is provided. The monitor, when used in conjunction with a closed-loop cooling system, comprises a coating comprising an indicator material having an activation temperature. The coating is situated on the internal cooling passages of the critical component. The monitor further comprises a sensor connected to an outlet conduit of the cooling system for determining the amount of degradation of indicator material by monitoring the cooling fluid flowing through the outlet conduit. Embodiments further comprising "sniffer" tubes for use with open-loop air cooling systems also are provided. In alternative embodiments, auxiliary cooling systems for supplying auxiliary cooling to critical components at certain activation temperatures also are provided.

3 Claims, 4 Drawing Sheets

ON-LINE MONITOR FOR DETECTING EXCESSIVE TEMPERATURES OF CRITICAL COMPONENTS OF A TURBINE

This application is a division of application Ser. No. 09/129,905 filed Aug. 6, 1998 now U.S. Pat. No. 6,062,811 issued on May 16, 2000.

FIELD OF THE INVENTION

The present invention relates generally to gas turbines, and more particularly to the temperature monitoring of critical components of a gas turbine.

BACKGROUND OF THE INVENTION

Combustion turbines comprise a casing or cylinder for housing a compressor section, combustion section and turbine section. The compressor section comprises an inlet end and a discharge end. The combustion section comprises an inlet end and a combustor transition. The combustor transition is proximate the discharge end of the combustion section and comprises a wall which defines a flow channel which directs the working gas into the turbine section.

A supply of air is compressed in the compressor section and directed into the combustion section. The compressed air enters the combustion inlet and is mixed with fuel. The air/fuel mixture is then combusted to produce high temperature and high pressure gas. This working gas is then ejected past the combustor transition and injected into the turbine section to run the turbine.

The turbine section comprises rows of vanes which direct the working gas to the airfoil portions of the turbine blades. The working gas flows through the turbine section causing the turbine blades to rotate, thereby turning the rotor, which is connected to a generator for producing electricity.

As those skilled in the art are aware, the maximum power output of a gas turbine is achieved by heating the gas flowing through the combustion section to as high a temperature as is feasible. The hot gas, however, heats the various turbine components, such as the transition, vanes and ring segments, that it passes when flowing through the turbine. Such components are critical components because their failure has direct impact on the operation and efficiency of the turbine.

Accordingly, the ability to increase the combustion firing temperature is limited by the ability of the critical components to withstand increased temperatures. Consequently, various cooling methods have been developed to cool turbine hot parts. These methods include open-loop air cooling techniques and closed-loop cooling systems.

Conventional open-loop air cooling techniques divert air from the compressor to the combustor transition to cool the turbine hot parts. The cooling air extracts heat from the turbine components and then transfers into the turbine's flow path where it merges with the working gas of the turbine.

Conventional turbine closed-loop cooling assemblies receive cooling fluid, either air or steam, from a source outside the turbine and distribute the cooling fluid circumferentially about the turbine casing. Unlike open-loop cooling systems, the closed-loop cooling fluid typically flows through a series of internal cooling passages of a critical component, while remaining separated from the working gas that flows through the turbine. After cooling the critical component, the cooling fluid is diverted through channels to a location outside the turbine.

Thermal Barrier Coatings (TBCs) are commonly used to protect critical components from premature breakdown due to increased temperatures to which the components are exposed. Previously, TBCs were used solely to extend the life of critical components by reducing the rate of metal waste (through spalling) by oxidation.

At present, in Advanced Turbine Systems (ATSs), however, the operating characteristics are such that the survivability of the TBC on blades and vanes is critical to the continuing operation of the turbine. Essentially, the high temperature demands of ATS operation and the limits of their state-of-the-art materials make the presence of the TBCs critical to the continued life of the underlying critical components. Failure of the TBC results in failure to meet design requirements and engine failure. It is, therefore, desirable to provide a system that would monitor the level of TBCs on critical components of a combustion turbine to signal when a critical component begins to overheat.

Critical components can also overheat for reasons other than due to TBC erosion, such as blocked cooling passages, cooling chamber failures or cooling media supply failures. It is, therefore, desirable to provide a system that would determine when a critical component begins to overheat.

Monitoring the condition of a TBC in the hostile environment of an operating combustion turbine is not easy. Because TBCs generally fail by spalling at or close to the coating/ceramic layer interface, coating degradation can be only indirectly observed from the external surfaces of a blade or vane. It is, therefore, desirable to provide a monitoring system that utilizes remote sensing.

There are particular challenges attendant to monitoring turbine vanes. The vanes are stationary, but are numerous. Typically, in an ATS, there are at least 30 vanes in a vane row. Therefore, multiple or distributed sensors must be employed to properly monitor each vane. The use of multiple sensors, however, would be expensive, unless inexpensive sensors were used, which would not perform well under such adverse environmental conditions found in an operating turbine. It is, therefore, desirable to provide a monitoring system that would be both cost effective and relatively inexpensive.

SUMMARY OF THE INVENTION

A monitor for detecting overheating of a critical component in a combustion turbine is provided. The monitor, when used in conjunction with a closed-loop cooling system, comprises a coating comprising an indicator material having an activation temperature. The coating is situated on the internal cooling passages of the critical component. The monitor further comprises a sensor connected to an outlet conduit of the cooling system for determining the amount of degradation of indicator material by monitoring the cooling fluid flowing through the outlet conduit.

Alternative embodiments of the present invention for detecting the amount of overheating of a critical component include a sensor to detect the spalling of the critical component's thermal barrier coating. Other embodiments for detecting the amount of overheating when the critical component comprises chromium, includes a sensor to determine the amount of chromia gas emitted from the internal cooling passages of the critical component. In preferred embodiments of the present invention, the critical component is a vane.

When used in conjunction with an open-loop air cooling system, the monitor of the present invention further comprises a "sniffer" tube extending from a space inside internal cooling passages of a critical component to the sensor, which in this case, is located outside the internal cooling passages.

The sniffer tube is provided for transporting a sample of cooling air to the sensor.

In alternative embodiments of the present invention where the closed-loop cooling system comprises a plurality of outlet conduits or a plurality of critical components, a plurality of sensors are used. Similarly, when multiple critical components are being cooled with an open-loop air cooling system, a plurality of sensors are employed. In preferred embodiments, the monitor of the present invention further comprises a data acquisition system for receiving readings from the sensors.

In alternative embodiments of the present invention, auxiliary cooling systems for supplying auxiliary cooling to critical components at certain activation temperatures are provided. These auxiliary cooling systems comprise a critical component having an auxiliary cooling feature such as a turbulator or extra cooling channel, hidden beneath a layer of coating. The coating comprises an indicator material having an activation temperature such that the auxiliary cooling feature is activated after the temperature of the indicator material reaches the activation temperature.

DETAILED DESCRIPTION OF THE PREFERRED EMBODIMENTS

The present invention detects the overheating of a critical component of a turbine. In a preferred embodiment, the present invention monitors the Thermal Barrier Coating (TBC) on a critical component by using critically volatile coatings. A preferred embodiment exploits a feature displayed by many nickel-based superalloys and coatings, materials of which critical components of a turbine are composed. Although alternative embodiments of the present invention can cool all critical components of a turbine, the embodiment described below is used to cool the vanes of an Advanced Turbine System (ATS) as well as other gas turbines.

It has been determined that these alloys are chromium rich and form chromia scale under oxidation and that above approximately 1800° F., the scale is volatile. The design conditions of ATSs indicate that local internal vane temperature excursions above 1800° F. are not normally expected. Therefore, such temperature excursions should only be caused by degradation of the TBC and on-setting failure of the vane.

Figure 1A:
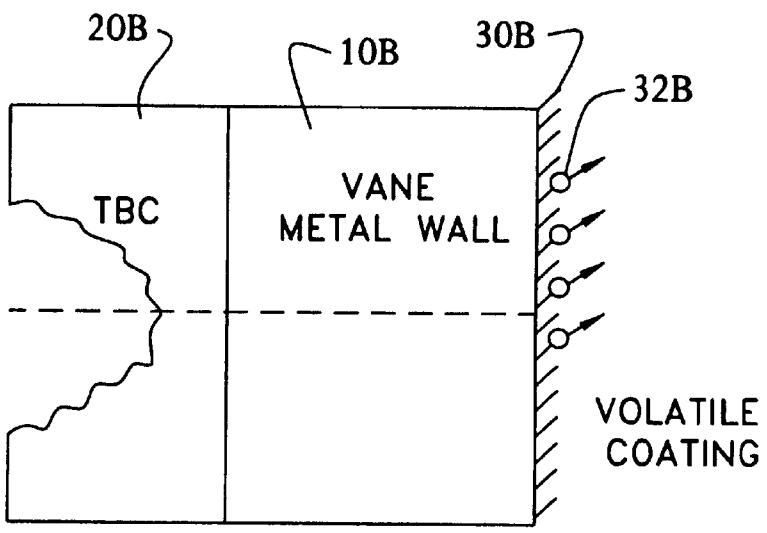
FIG. 1A is a schematic of the vane wall of FIG. 1 with spalling of the thermal barrier coating.
Figure 1:
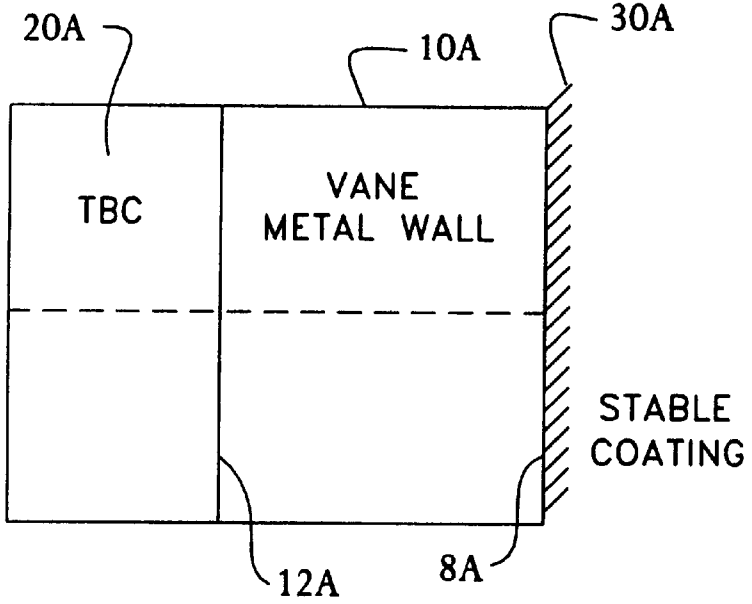
FIG. 1 is a schematic of a thermal barrier coating on an vane wall's external surface and an indicator coating on the interior surface.

FIGS. 1 and 1A show a schematic for demonstrating the principle of using a volatile coating for detecting the loss of a vane's TBC. FIG. 1 depicts the situation where the temperature is relatively low, i.e., below 1800°F. Here, the TBC 20A on the outer surface 12A (exposed to the working gas of the turbine if not for the TBC 20A) of the vane wall 10A shows no spalling and the coating 30A on the inner surface 8A (exposed to the cooling fluid if not for the coating 30A) of the vane wall 10A is still stable.

FIG. 1A depicts the situation where the temperature is relatively high, i.e., above 1800° F. Here, the TBC 20B shows significant spalling and the coating 30B has become volatile. If 30B represents chromium in the alloy of the vane, then 32B represents chromia gas, to which the chromia scale sublimes. The chromia gas 32B is about to be carried away by the cooling fluid flowing through the internal cooling passages of the vane.

Figure 2:
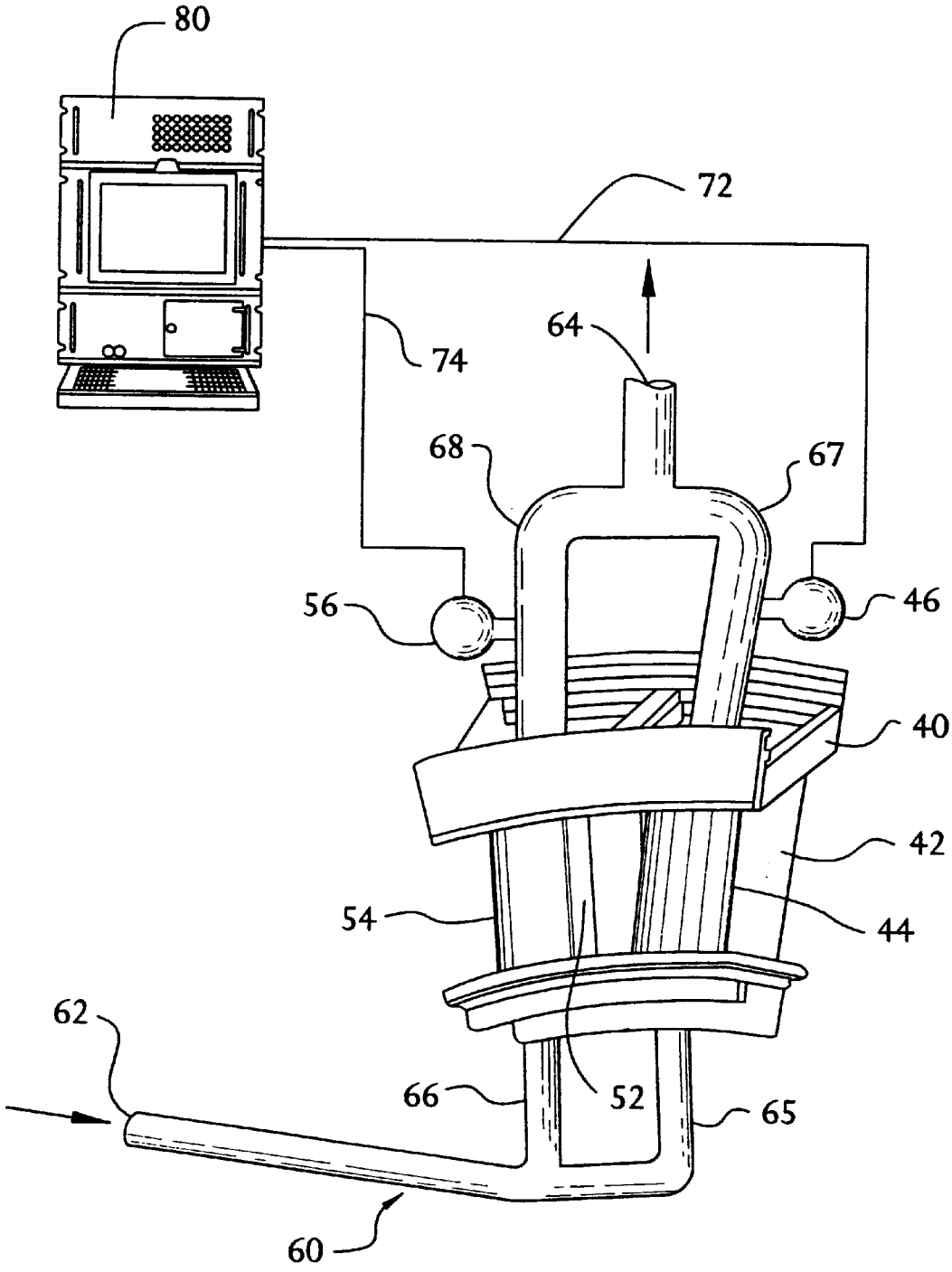
FIG. 2 is an axial view of a vane monitor according to the present invention.

Monitoring the chemistry of the internal medium of a vane, i.e., checking for volatile chromia 32B in the cooling fluid, should effectively monitor the condition of the vane's TBC. FIG. 2 shows an axial view of a vane monitor according to the present invention. One vane segment 40 of a row of vanes in cooperation with the monitoring system are represented. The monitor, as shown in FIG. 2, works in cooperation with a closed-loop cooling system 60 and comprises two sensors 46 and 56, two electrical leads 72 and 74 and a data acquisition system 80.

The closed-loop cooling system 60 comprises an inlet 62 for receiving cooling fluid outside the turbine, inlet conduits 65 and 66 for supplying the cooling fluid to each vane 42 and 52, outlet conduits 67 and 68 for removing the cooling fluid from each vane 42 and 52, and an outlet 64 for exhausting the cooling fluid from the turbine. The cooling fluid flows through internal cooling passages 44 and 54 within the vanes 42 and 52, respectively.

With closed-loop cooling of the vane segment 40, the returning cooling fluid is monitored for chromia gas 32B by using an array of relatively inexpensive sensors. As shown in FIG. 2, one sensor 46 or 56 is used for each vane 42 or 52, respectively. These inexpensive sensors are effective because they are remote from the location being monitored. The sensors 46 and 56 are outside the vane segments 40 and 50 connected to the outlet conduits 67 and 68, respectively, away from the hottest area of the turbine and not exposed to the harsh environmental conditions of the working gas of the turbine.

The sensors 46 and 56 are connected to the data acquisition system 80 by means of electrical leads 72 and 74, which transmit readings from the sensors 46 and 56, respectively. The data acquisition system 80 receives and interprets the readings to determine the amount and rate of any TBC degradation. The data acquisition system 80 can also display readings or results on-line. In an alternative embodiment of the present invention, the data acquisition system 80 receives readings remotely without electrical leads 72 and 74.

The selection of a sensor for the monitor of the present invention is based on which critically volatizable coating is used inside the vane's internal cooling passages 44 and 54. In a preferred embodiment, as described above, the chromia gas 32B from the chromium 30B in the vane material is used as the indicator, so a coating need not be provided. Coatings, however, may be utilized. Such coatings need unique or different activation temperatures, e.g., melting, sublimation or evaporation temperatures, to serve in the same fashion as chromium, having a unique sublimation temperature of 1800° F. Possible sensors for detecting chromia scale comprise a chemical trap that will be monitored for conductivity or acidity, or spectrometers for more sensitive measurements, if so required.

If coatings are used, their activation temperatures would probably not be 1800° F. and thus, would not be an ideal indicator to monitor the level of erosion of TBC on a critical component. With these coatings, however, the monitor of the present invention is used to simply detect overheating of the critical component, which would be based on the activation temperature of the coating used. In addition, if multiple coatings with individual and different activation temperatures are used, then multiple indicators or warnings will be provided, one at each coating's respective activation temperature. For example, a coating with an activation temperature of 1850° F. will provide a warning at this temperature. With increasing temperature, a second coating with an activation temperature of 1900° F. will provide a warning at this temperature, and so on.

In an alternative embodiment for turbines using open-loop air cooling techniques, the chromia gas 32B will be carried away with the air and merge with the working gas of the turbine. Thus, in this scenario, a more expensive sensor will be required because monitoring will take place under relatively harsh environmental conditions. A sensor with greater sensitivity will also be required due to dilution of the gas from the indicator material in the stream of working gas. Although more costly, fewer monitors will be needed because the sensors are placed slightly more downstream than where the row of vanes being monitored is located.

Figure 3:
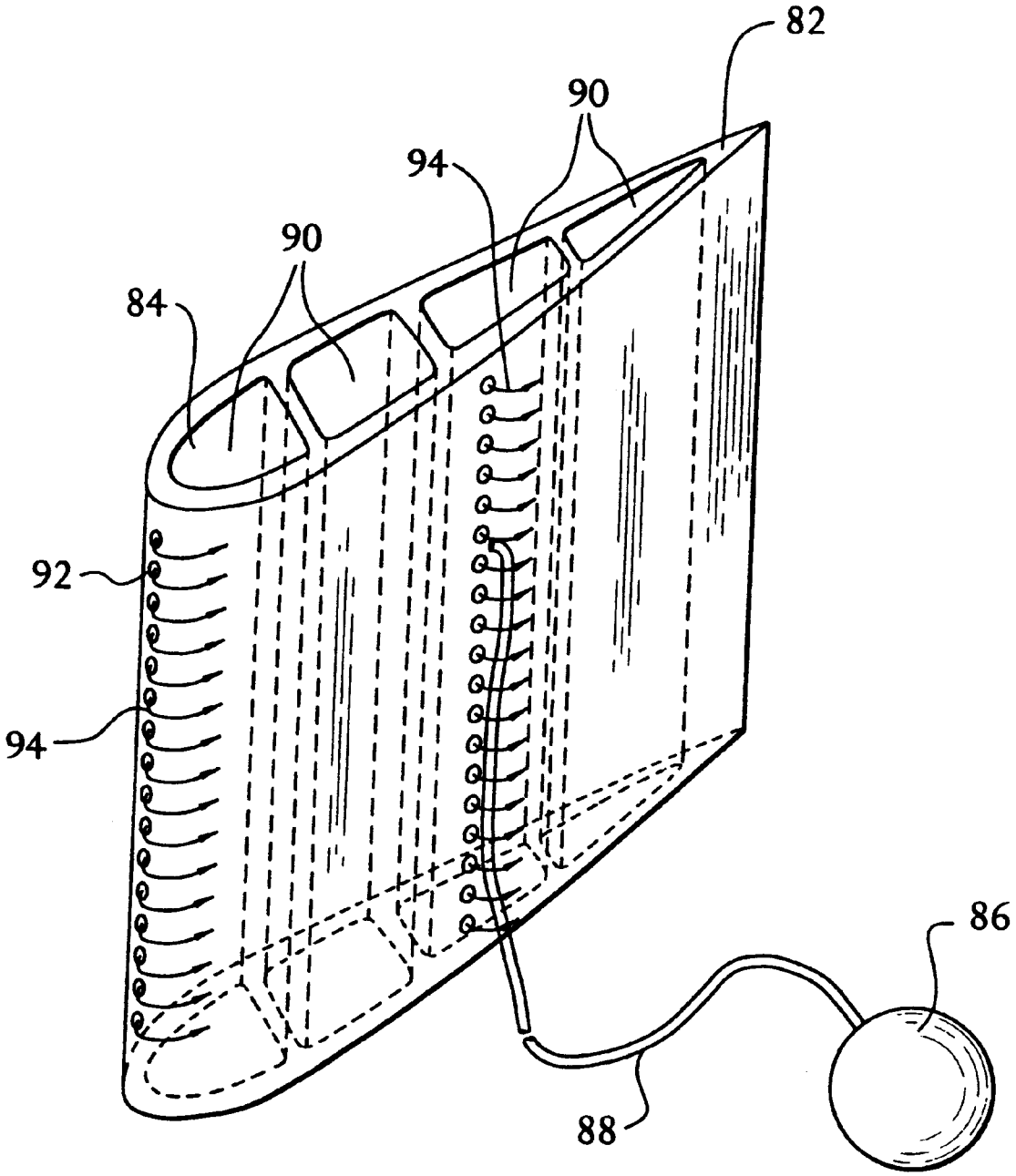
FIG. 3 is a perspective view of an alternative embodiment of a vane monitor according to the present invention.

FIG. 3 shows a perspective view of an alternative embodiment of the vane monitor according to the present invention in cooperation with an open-loop air cooling system. As cooling air 90 flows through the internal cooling passages 84, some escapes through cooling holes 92, forming thin laminar films of protective cooling gas 94 on the surface of the vane 82. In this embodiment, a "sniffer" tube 88 is situated inside an internal cooling passage 84 of the vane 82. The sniffer tube 88 periodically "sniffs" in samples of gas and transports them to a sensor 86. In this manner, the sniffer tube 88 is used to sample released gas from the indicator material before it becomes diluted or escapes to exhaust. In alternative embodiments, more than one sniffer tube 88 can be used.

Alternative embodiments of the present invention include new component designs. Such new designs of auxiliary cooling systems have auxiliary cooling features built into the critical component which are activated only in the event of overheating of the component, i.e., at certain activation temperatures. This activation temperature depends on the specific indicator material used. As a result of the overheating, additional cooling passages in the critical component are opened to receive cooling fluid or additional cooling features such as turbulators are activated.

Figure 4A:
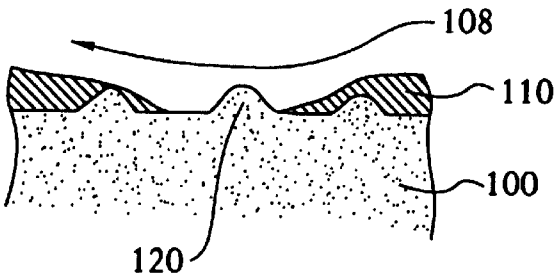
FIG. 4A is a cut-away, cross-sectional schematic of the critical component of FIG. 4 with spalling of the indicator coating.
Figure 4:
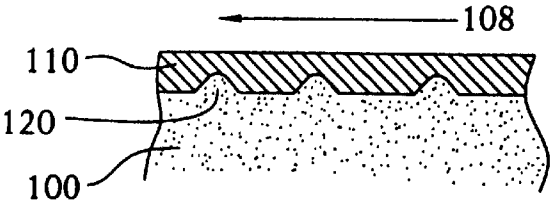
FIG. 4 is a cut-away, cross-sectional schematic of a critical component having turbulators covered by a layer of indicator coating.

FIGS. 4 and 4A depict the cooling mechanism of turbulators 120 in accordance with principles of the present invention. In FIG. 4, the temperature is relatively low (less than the indicator coating's activation temperature) and there is no degradation of the indicator coating 110 covering the base metal 100 (e.g., a surface of a vane wall) as the cooling gas 108 flows across the surface of the indicator coating 110. In FIG. 4A, however, the temperature is relatively high (greater than the activation temperature) and there is degradation of the indicator coating 110, thereby exposing the turbulators 120 to increase the cooling effects of the cooling gas 108.

Figure 5A:
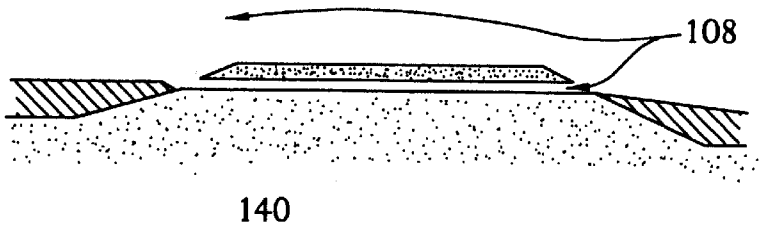
FIG. 5A is a cut-away, cross-sectional schematic of the critical component of FIG. 4 with degradation of the indicator coating.
Figure 5:
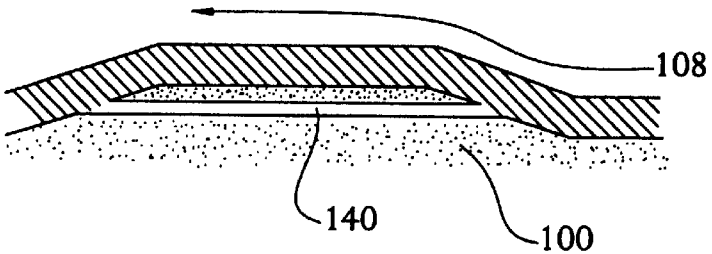
FIG. 5 is a cut-away, cross-sectional schematic of a critical component having a cooling channel covered by a layer of indicator coating.

FIGS. 5 and 5A depict the mechanism of extra cooling channels 140 in accordance with principles of the present invention. In FIG. 5, the temperature is relatively low (less than the indicator coating's activation temperature) and there is no degradation of the indicator coating 110 covering the base metal 100 as the cooling gas 108 flows across the surface of the indicator coating 110. In FIG. 5A, however, the temperature is relatively high (greater than the activation temperature) and there is degradation of the indicator coating 110, thereby exposing the extra cooling channel 140 to increase the cooling effects of the cooling gas 108.

The monitor of the present invention effectively monitors the level of TBCs on critical components of a combustion turbine by detecting the amount of indicator (or coating material) released from the critical component as a result of degradation of the TBC. Measuring the indicator material that is released in the return of cooling fluid that passes through the internal cooling passages of a critical component allows the present invention to utilize remote sensing. As a result of the remote sensing, the present invention achieves monitoring that is both cost effective and relatively inexpensive.

The design of the monitor of the present invention also takes advantage of closed-loop cooling techniques, which yields more efficient turbine operation and is more common in today's generation of combustion turbines. Because the present invention only needs sensors installed in relatively accessible areas of the turbine, the monitor requires a minimum amount of redesign and therefore, relatively low installation costs. The use of sniffer tubes with open-loop air cooling systems provides these benefits as well.

The ability of the monitor of the present invention to use the material of which the critical components are composed, i.e, the chromium, as the indicator material yields several benefits. The chromium provides the monitor with an intrinsic indicator of overheating of critical components. As a result, the monitor is capable of operating many times without depleting the indicator material. In addition, an additional indicator material need not be supplied, another reason for low installation cost of the monitor.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. In combustion turbine, a critical component comprising:

an auxiliary cooling feature, wherein cooling gas is in fluid communication with at least one surface of the critical component; and an auxiliary cooling system comprising:

a coating on at least the one surface of the critical component, said coating comprising an indicator material having an activation temperature such that said auxiliary cooling feature is activated after the temperature of said indicator material reaches the activation temperature.

2. The critical component of claim 1, wherein the auxiliary cooling feature is a turbulator.

3. The critical component of claim 1, wherein the auxiliary cooling feature is a cooling channel.

* * * * *